US009914159B2

(12) United States Patent
Yamamoto et al.

(10) Patent No.: US 9,914,159 B2
(45) Date of Patent: Mar. 13, 2018

(54) METHOD FOR PRODUCING PLUG FOR PIERCING-ROLLING

(71) Applicant: NIPPON STEEL & SUMITOMO METAL CORPORATION, Tokyo (JP)

(72) Inventors: Tomohiro Yamamoto, Tokyo (JP); Yasuto Higashida, Tokyo (JP); Yasuyoshi Hidaka, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 120 days.

(21) Appl. No.: 14/396,762

(22) PCT Filed: Mar. 19, 2013

(86) PCT No.: PCT/JP2013/001856
§ 371 (c)(1),
(2) Date: Oct. 24, 2014

(87) PCT Pub. No.: WO2013/161175
PCT Pub. Date: Oct. 31, 2013

(65) Prior Publication Data

US 2015/0135513 A1 May 21, 2015

(30) Foreign Application Priority Data

Apr. 25, 2012 (JP) ..... 2012-099435

(51) Int. Cl.
*B21B 25/00* (2006.01)
*C23C 4/10* (2016.01)
(Continued)

(52) U.S. Cl.
CPC ..... *B21B 25/00* (2013.01); *B21B 19/04* (2013.01); *C23C 4/02* (2013.01); *C23C 4/06* (2013.01);
(Continued)

(58) Field of Classification Search
CPC ..... B21B 25/00; B21B 19/04; C23C 4/131; C23C 4/06; C23C 4/02; Y10T 29/49986
See application file for complete search history.

(56) References Cited

U.S. PATENT DOCUMENTS 3,332,752 A * 7/1967 Batchelor ..... B05B 7/203 427/180
5,194,304 A * 3/1993 McCune, Jr. ..... B05B 7/224 427/224
(Continued)

FOREIGN PATENT DOCUMENTS

| | | |
|---|---|---|
| DE | 10 2008 02422 | 11/2009 |
| EP | 2 198 984 | 6/2010 |
| JP | 4279350 | 6/2009 |

*Primary Examiner* — John C Hong
(74) *Attorney, Agent, or Firm* — Clark & Brody

(57) ABSTRACT

Provided is a method for producing a plug for use in a piercing-rolling mill for producing a seamless steel tube/pipe, and the method for producing the plug for piercing-rolling comprises shotblasting a surface of the plug, and arc-spraying a spray wire so as to form a film on a surface of a base metal of the plug that is shotblasted. In the arc-spraying step, the arc spraying is carried out by using, as the spray wire, a cored wire whose iron sheath tube is charged with at least iron oxide particles among iron particles and the iron oxide particles (one or more of FeO particles, $Fe_3O_4$ particles, and $Fe_2O_3$ particles), so as to form the film containing iron oxide and Fe. Accordingly, it is possible to enhance the production efficiency of the plug, and to produce the plug for piercing-rolling capable of securing the steady enhancement of the durability life of the plug during the piercing-rolling.

3 Claims, 1 Drawing Sheet

(51) Int. Cl.

| | |
|---|---|
| ***B21B 19/04*** | (2006.01) |
| ***C23C 4/02*** | (2006.01) |
| ***C23C 4/06*** | (2016.01) |
| ***C23C 4/131*** | (2016.01) |

(52) U.S. Cl.
CPC ..... *C23C 4/131* (2016.01); *Y10T 29/49986* (2015.01)

(56) References Cited

U.S. PATENT DOCUMENTS

2010/0050723 A1* 3/2010 Hidaka ..... B21B 25/00 72/97
2015/0184276 A1* 7/2015 Saitou ..... B21B 19/04 427/449

* cited by examiner

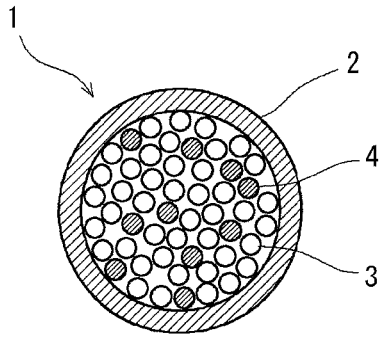
1
2
4
3

METHOD FOR PRODUCING PLUG FOR PIERCING-ROLLING

TECHNICAL FIELD

The present invention relates to a method for producing a plug for piercing-rolling (hereinafter, also referred to simply as a "plug") for use in a piercing-rolling mill (hereinafter, also referred to simply as a "piercer") that produces a seamless steel tube/pipe, particularly to a method for producing a plug for piercing-rolling having a film formed by performing arc-spraying of a spray wire mainly containing iron, on a surface of a plug base metal.

BACKGROUND ART

A seamless steel tube/pipe is produced by the Mannesmann tube-making process. The Mannesmann tube-making process includes the following steps:

(1) piercing-rolling a starting material (round billet) heated at a predetermined temperature into a hollow shell by using a piercer;

(2) elongation-rolling the hollow shell by an elongation rolling mill (e.g. mandrel mill); and (3) carrying out diameter adjusting rolling on the elongation-rolled hollow shell to have a predetermined outer diameter and wall thickness by using a diameter adjusting rolling mill (e.g. a stretch reducer).

In the piercing-rolling by using the piercer, a plug is used as a piercing tool. This plug is mounted to a front end of a mandrel so as to pierce a billet heated at a high temperature of approximately 1200° C.; thus the plug is exposed to a hostile environment with a high surficial pressure and a high temperature. In general, the plug includes a base metal made of hot working tool steel, and a film of oxide scale is formed on a surface of the base metal through a heating process in advance for the purpose of protection of the base metal, and thereafter the plug is used in the piercing-rolling. During the piercing-rolling, the scale film on the surface of the plug blocks heat transfer from the billet to the base metal of the plug, and also prevents seizing between the billet and the plug.

Repetitive piercing-rolling using such a plug having the scale film causes a gradual abrasion of the scale film. The abrasion of the scale film deteriorates thermal insulation effect of the film, resulting in increased temperature of the plug during the piercing, so that melting-incurred metal loss and deformation by heat are likely to be caused to the plug base metal. If the scale film is exhausted, and the plug base metal comes into direct contact with the billet, seizing is caused, so as to generate flaws on an internal surface of a steel tube/pipe. Consequently, the plug becomes unavailable at the moment when the film is exhausted, and its durability life is expired.

Particularly in production of a seamless steel tube/pipe made of high alloy steel such as high Cr steel containing Cr of 9% or more, Ni-based alloy, and stainless steel, significant abrasion of the scale film on the surface of the plug is generated during the piercing-rolling, so that the durability life of the plug becomes significantly reduced. For example, in the case of piercing stainless steel, the scale film on the surface of the plug becomes worn away through several passes (the number of times of continuous piercing rolling), and the durability life of this plug is expired. This requires a frequent replacement of the plug, which deteriorates the production efficiency of the steel tube/pipe. In production of a seamless steel tube/pipe of high alloy steel, it is required to enhance the durability life of the plug during the piercing-rolling, thereby enhancing the production efficiency of the steel tube/pipe.

To satisfy such a requirement, as an example of the film formed on the surface of the plug base metal, Patent Literature 1 discloses such a plug having a film containing Fe oxide and Fe formed on the surface of the plug base metal by performing arc-spraying of iron wire, instead of using the scale film formed through heat treatment. Since the plug having the arc-sprayed film has a film containing Fe oxide and Fe on the surface of the plug, this plug is excellent in thermal insulation performance and seizing prevention, so that enhancement of the durability life of the plug is likely to be achieved.

In the plug having the arc-sprayed film disclosed in the Patent Literature 1, the Fe oxide contained in the film is generated by the arc-spraying that melts the iron wire, and oxidizes the molten material (Fe) in the air before the molten material reaches the surface of the plug base metal. Hence, it is required to have a relatively large spraying distance from a spraying equipment to the surface of the plug base metal, so as to secure sufficient time for the melt material to be sputtered in the air (time required for oxidizing the material); however, if the spraying distance is too large, some of the molten material cannot reach the surface of the plug base metal. As a result, it likely takes more time to form the film, which hinders enhancement of the production efficiency of the plug.

The content of Fe oxide in the film depends on the development condition of oxidization of the molten material, and a desired content may not be secured in the film; consequently, the durability life of the plug may become unstable. In view of these facts, there is still room for further improvement in enhancement of the production efficiency of the plug as well as securing the steadily enhanced durability life of the plug, and thus it has been desired to produce a plug for piercing-rolling that can realize the above improvement.

CITATION LIST

Patent Literature

Patent Literature 1: Japanese Patent No. 4279350

SUMMARY OF INVENTION

Technical Problem

An object of the present invention, which has been made in order to solve the problems encountered in the conventional art, is to provide a method for producing a plug for piercing-rolling having a film formed on a surface of the plug base metal by performing arc-spraying of a spray wire mainly containing iron, and the method has the following features:

(1) enhancing production efficiency of the plug; and (2) securing steady enhancement of the durability life of the plug.

Solution to Problem

The summary of the present invention is as follows.

The present invention provides a method for producing a plug for use in a piercing-rolling mill for producing a seamless steel tube/pipe, and the method for producing the plug for piercing-rolling comprises the steps of:

shotblasting a surface of the plug; and arc-spraying a spray wire so as to form a film on a surface of a base metal of the plug that is shotblasted .

In the arc-spraying step, the arc-spraying is carried out by using, as the spray wire, a cored wire whose iron sheath tube is charged with at least iron oxide particles among iron particles and the iron oxide particles, so as to form the film containing iron oxide and Fe.

In this producing method, the iron oxide particles preferably comprise one or more of FeO particles, $Fe_3O_4$ particles, and $Fe_2O_3$ particles.

Advantageous Effects of Invention

The method for producing a plug for piercing-rolling according to the present invention achieves the following remarkable effects:

(1) enhancing production efficiency of the plug; and (2) securing steady enhancement of the durability life of the plug.

BRIEF DESCRIPTION OF DRAWINGS

FIG. 1 is a cross sectional drawing showing a spray wire for use in arc-spraying in the method for producing a plug for piercing-rolling according to the present invention.

DESCRIPTION OF EMBODIMENTS

In order to achieve the above object, the present inventors conducted various tests and intensive studies on the method for forming a film on a surface of a plug base metal by performing arc-spraying of a spray wire mainly containing iron. As a result, the present inventors have obtained the following findings.

The arc-spraying generates arcs between front ends of two lines of spray wires serving as electrodes, so as to melt the spray wires, and at the same time, a compressed air jet or a nitrogen gas jet is supplied between the front ends of the spray wires so that the molten material is blown off, thereby spraying the molten material onto a target object to form a film thereon, for example. In the arc-spraying disclosed in the Patent Literature 1, an iron wire is used as the spray wire, and thus a film formed on the surface of the plug base metal containing Fe oxide (iron oxide) and Fe. The Fe oxide contained in the film is generated by melting the iron wire during the arc-spraying, and oxidizing the molten iron in the air before the molten iron reaches the surface of the plug base metal. Fe contained in the film results from the molten iron that has reached the surface of the plug base metal without being oxidized in the air.

Meanwhile, the film containing Fe oxide (iron oxide) and Fe can be formed on the surface of the plug base metal, as similar to that disclosed in Patent Literature 1, by performing arc-spraying of a cored wire as the spray wire; and the cored wire comprises an outer sheath tube made of iron which is the same as that of the iron wire, and is charged with iron oxide particles, and also with iron particles in some cases. Fe oxide contained in this film is generated such that the iron sheath tube included in the cored wire as well as the iron particles are melted during the arc-spraying, the molten iron is oxidized in the air before reaching the surface of the plug base metal, and the iron oxide particles included in the cored wire are melted, and this molten material reaches the surface of the plug base metal. Fe contained in the film is generated such that the molten iron reaches the surface of the plug base metal without being oxidized in the air.

The Fe oxide contained in the film and generated by performing arc-spraying of the cored wires can be mostly resulted from the iron oxide particles included in the cored wires if the spraying distance from the spraying equipment to the surface of the plug base metal is set to be short in advance before the arc-spraying is carried out. The filling rate of the iron oxide particles is appropriately adjusted so that the Fe oxide contained in the film can be at a desired content. Hence, the plug having the arc-sprayed film produced in the above manner has the desirable content of the Fe oxide in the film, thereby securing steady enhancement of the durability life of the plug during the repetitive piercing-rolling. In the arc-spraying, the Fe oxide is resulted from the iron sheath tube and the iron particles included in the cored wire, and these materials are unnecessary to be actively oxidized to generate the Fe oxide during the arc-spraying, which contributes to the decrease in the spraying distance. Accordingly, it is possible to shorten time required for forming the film, and enhance the production efficiency of the plug.

The present invention has been made based on the above described findings. Hereinafter, description will be provided on the preferred embodiment of the method for producing the plug according to the present invention.

In the method for producing the plug according to the present invention, prior to the arc-spraying, shotblasting is carried out on the surface of the plug. In the case of reproducing the plug the durability life of which is expired through the repetitive piercing-rolling, the piercing-rolled film remaining on the surface of the plug is removed through the shotblasting so as to expose the surface of the plug base metal, and to moderately roughen the surface of the plug base metal. In the case of producing a new plug, the surface of the plug base metal is allowed to be moderately rough through the shotblasting. The reason for the shotblasting treatment is because the plug base metal having a moderate rough surface with no remaining film enhances adhesiveness between the plug base metal and the film at the time of the arc-spraying.

In the method for producing the plug according to the present invention, following the above step, the cored wire mainly containing iron, used as the spray wire, is arc-sprayed on the surface of the plug base metal to which the shotblasting is applied, thereby forming the film thereon.

FIG. 1 is a cross sectional view showing the spray wire for use in the arc-spraying in the method for producing the plug for piercing-rolling according to the present invention. As shown in this drawing, in the preset invention, a cored wire 1 is used as the spray wire. This cored wire 1 includes an outer sheath tube 2 made of iron.

The iron sheath tube 2 is charged with iron oxide particles 3. The iron oxide particles 3 may be any type among iron oxide (II) (FeO) particles, iron oxide (III) ($Fe_2O_3$) particles, and iron oxide (II, III) ($Fe_3O_4$) particles. The iron oxide particles 3 may include a mixture of more than one type of these iron oxide particles. The iron oxide particles 3 are not limited to be in the form of particles, and may include powders or chopped fibers.

The iron sheath tube 2 may also be charged with iron particles 4 in addition to the iron oxide particles 3. The iron particles 4 are not limited to be in the form of particles, and may include powders or chopped fibers.

The arc-spraying using the cored wire (spray wire) 1 having the above configuration enables formation of the film containing Fe oxide (iron oxide) and Fe on the surface of the plug base metal. At this time, if the spraying distance is set to be short in advance, most of the Fe oxide in the film is allowed to result from the iron oxide particles 3 included in the cored wire 1. Hence, the filling rate of the iron oxide particles 3 are appropriately adjusted so that the Fe oxide in the film have a desired content. In addition, the Fe oxide result from the iron sheath tube 2 and the iron particles 4 included in the cored wire 1, and the two materials are unnecessary to be actively oxidized during the arc-spraying so as to generate the Fe oxide, which contributes to the decrease in the spraying distance. Accordingly, the time required for forming the film can be shortened, thereby enhancing the production efficiency of the plug. The plug with the arc-sprayed film produced in such a manner contains the Fe oxide in the film at the desired content. Accordingly, the durability life of the plug is enhanced during the repetitive piercing-rolling If one or more types selected from a group consisting of the FeO particles, $Fe_3O_4$ particles, and $Fe_2O_3$ particles is used as the iron oxide particles 3, the proportion of the iron oxide particles 3 in the entire cored wire 1 including the iron sheath tube 2 and the iron oxide particles 3 as well as the iron particles 4 is preferably 45 to 75 volume %, and more preferably 50 to 70 volume %. The reason for this is as follows.

As disclosed in Patent Literature 1, the proportion of the region of the Fe oxide in the film containing the Fe oxide and Fe (referred to as an "oxide proportion", hereinafter) is preferably 55 to 80%, and more preferably 60 to 75% in the light of enhancement of the durability life of the plug. At this time, if the arc-spraying is carried out by using the above described cored wire 1, the Fe oxide resulting from the iron sheath tube 2 and the iron particles 3 is generated, and is contained in the film to some extent. While predicting the amount of the Fe oxide to be generated, the proportion of the iron oxide particles 3 in the cored wire 1 is adjusted to be in the above preferable range so that the oxide proportion in the film is in the above preferable range.

In the method for producing the plug according to the present invention, the arc-spraying may be carried out while the spraying equipment is being gradually distanced away from the surface of the plug base metal, so as to increase the spraying distance gradually during the formation of the film through the arc-spraying. In this manner, a film is formed on the plug base metal such that the oxide proportion therein gradually increases toward the surface. The film having such an oxide proportion that is smaller at a portion adjacent to the plug base metal, and greater on its surface is useful in the light of securing thermal insulation performance and seizing prevention performance on the surface of the film as well as securing the adhesiveness between the film and the portion adjacent to the plug base metal.

EXAMPLE

For the purpose of inspecting the effects of the present invention, a piercing-rolling test was conducted in such a manner that plugs for piercing-rolling were produced, and each of the produced plugs was mounted to a piercer so as to carry out the piercing-rolling. The test condition was as follows.

[Test Method]

(1) Production of Plug

A number of bullet-shaped plugs, each having a maximum diameter of 147 mm, were prepared using hot-working tool steel specified by the JIS standard as the base metal. Plugs having the arc-sprayed film were produced such that, after the shotblasting was applied to the surface of each plug, the arc-spraying was carried out by using a cored wire shown in FIG. 1, so as to form a film on the surface of the base metal of each plug.

At this time, as shown in Table 1 below, various cored wires were used, which included FeO particles (Test No. 1), $Fe_3O_4$ particles (Test No. 2), $Fe_2O_3$ particles (Test No. 3), and a mixture of these particles (Test No.4), as the iron oxide particles in the cored wire. The proportion of the iron oxide particles in each cored wire was fixed at 60 volume %. The iron sheath tube of each cored wire was charged with iron particles along with the iron oxide particles depending on its percentage of the iron oxide particles. In addition, in the formation of the arc-sprayed film, the arc-spraying was conducted for each plug with the distance from the spraying equipment to the surface of the plug base metal being set to 100 mm. For the comparison, the arc-spraying using the iron wire shown in Patent Literature 1 was also conducted (Test No. 5), and in this arc-spraying, the spraying distance was constantly set to 600 mm that was longer than the case of the cored wire.

TABLE 1

| No. | Iron oxide particles in cored wire | Film formation time ratio | Plug durability life ratio |
|---|---|---|---|
| 1 | FeO | 0.3 | 1.2 |
| 2 | $Fe_3O_4$ | 0.4 | 1.3 |
| 3 | $Fe_2O_3$ | 0.5 | 1.2 |
| 4 | Mixture of FeO, $Fe_3O_4$, $Fe_2O_3$ | 0.3 | 1.5 |
| 5 | Iron wire instead of cored wire | 1.0 | 1.0 |

(2) Piercing-Rolling

Using the above various plugs, the following hollow shells were produced by repetitively piercing-rolling the following workpieces (materials) heated at about 1200° C.

Workpiece size: round billet of 191 mm in diameter and 2200 mm in length

Workpiece Material: 13% Cr steel

Hollow shell: 196 mm in outer diameter, 16.82 mm in wall thickness, 6520 mm in length

[Evaluating Method]

Studies on the film formation time through the arc-spraying were conducted, so as to evaluate the production efficiency of each plug. The production efficiency was evaluated on each of the plugs sprayed by the cored wires as being Test No. 1 to Test No. 4 based on the ratio of its film formation time (referred to as the "film formation time ratio", hereinafter), where the film formation time of the plug sprayed by the iron wire as shown in Test No. 5 of Table 1 above was indicated by the number "1.0" as a reference.

Each plug was subjected to the repetitive piercing-rolling, and inspection was conducted on the appearance of each plug after the piercing-rolling was completed. For each plug, counted was the number of rolling passes until the plug became unusable due to separation of the film, or had melting-incurred metal loss or deformation at the front end of the plug, in other words, the number of the billets that successfully underwent the continuous piercing-rolling (the number of times of continuous piercing-rolling) was counted. The number of times of continuous piercing-rolling was evaluated as the durability life of the plug. The durability life of the plug was evaluated on each of the plugs sprayed by the cored wires as being Test No. 1 to Test No. 4 based on the ratio of its durability life having the arc-sprayed film (referred to as the "plug durability life ratio", hereinafter), where the durability life of the plug sprayed by the iron wire as shown in Test No. 5 of Table 1 was indicated by the number "1.0" as a reference. The repetitive continuous piercing-rolling was carried out for each condition for fourteen plugs and an average value among the fourteen plugs was employed as the plug durability life for each condition.

[Test Result]

The test result is shown in Table 1. The following findings are obtained from the test result.

The film formation time was shortened in Test No. 1 to Test No. 4, which employed the cored wires charged with the iron oxide particles to form the film by arc-spraying, compared to Test No. 5 that was sprayed by the iron wire. This resulted from the reduced spraying distance. It was found the reduction of the film formation time can be realized by using the cored wire charged with the iron oxide particles, thereby enhancing the production efficiency of the plug. It was also found that the durability life of the plug was increased, and the steady enhancement of the durability life of the plug was secured by using the plug having the arc-sprayed films formed by employing the cored wire charged with the iron oxide particles, as shown in Test No. 1 to Test No. 4, compared to the case of using the iron wire in Test No. 5.

INDUSTRIAL APPLICABILITY

The present invention can be effectively used in the production of a seamless steel tube/pipe of high alloy steel.

REFERENCE SIGNS LIST

1: Cored wire (spray wire), 2: Iron sheath tube, 3: Iron oxide particles, 4: iron particles

What is claimed is:

1. A method for producing a plug for use in a piercing-rolling mill for producing a seamless steel tube/pipe, the method comprising:

shotblasting a surface of the plug; and arc-spraying a spray wire so as to form a film on a surface of a base metal of the plug that is shotblasted, wherein in the arc-spraying step, the arc-spraying is carried out by using, as the spray wire, a cored wire whose iron sheath tube is charged with at least iron oxide particles so as to form the film containing iron oxides and Fe, wherein the iron sheath charged with at least iron oxide particles results in a reduction in a time required to form the film having a predetermined oxide proportion on the surface of the base metal of the plug.

2. The method for producing a plug for piercing-rolling according to claim 1, wherein the iron oxide particles comprise one or more of FeO particles, $Fe_3O_4$ particles, and $Fe_2O_3$ particles.

3. The method for producing a plug for piercing-rolling according to claim 1, wherein the iron sheath tube is charged further with iron particles.

* * * * *